United States Patent [19]

Whaley

[11] Patent Number: 4,516,520

[45] Date of Patent: May 14, 1985

[54] METHOD AND APPARATUS OF THERMAL DETECTION USING BONDED COUPON

[75] Inventor: Hubert L. Whaley, Lynchburg, Va.

[73] Assignee: The Babcock & Wilcox Company, New Orleans, La.

[21] Appl. No.: 413,289

[22] Filed: Aug. 31, 1982

[51] Int. Cl.[3] ..... G01K 11/06

[52] U.S. Cl. ..... 116/217; 374/160

[58] Field of Search ..... 374/159, 160, 136, 210; 116/216, 217, 218; 166/57, 66, 113; 138/103, 104; 73/588, 597, 599

[56] References Cited

U.S. PATENT DOCUMENTS

| | | | |
|---|---|---|---|
| 2,937,527 | 5/1960 | Mason et al. | 374/136 |
| 3,451,479 | 6/1969 | Parker | 166/57 |
| 3,518,961 | 7/1970 | Kovac | 116/217 |
| 3,548,992 | 12/1970 | Dawson | 116/217 |
| 3,733,889 | 5/1973 | Proctor, Jr. | 73/588 |
| 3,845,662 | 11/1974 | Surgina et al. | 116/217 |
| 3,994,341 | 11/1976 | Anderson et al. | 166/57 |
| 4,056,970 | 11/1977 | Sollish | 73/597 |
| 4,272,988 | 6/1981 | Phillips et al. | 374/159 |
| 4,289,088 | 9/1981 | Scibelli | 374/160 |
| 4,307,612 | 12/1981 | Elsley et al. | 73/620 |

*Primary Examiner*—Richard R. Stearns
*Assistant Examiner*—David R. Schuster
*Attorney, Agent, or Firm*—James C. Simmons; Robert J. Edwards

[57] ABSTRACT

A coupon is bonded to a component using a bonding agent which is capable of withstanding temperatures only up to a selected temperature above which the bonding agent no longer holds the coupon to the component. The component, during an operation, is intended for exposure to temperatures not above the selected temperature. An exposure of the component to the elevated selected temperature is identified by the fact that the coupon is no longer bonded to the component after termination of the operation. When the component is provided with insulation, the selected temperature is chosen to correspond to a temperature at which the insulation fails to determine the integrity of the insulation after the insulation. The coupon may be bonded to an exterior or interior surface of the component. With an exterior bonded component, visual inspection is sufficient. With an interior bonded component, detection means such as ultrasonic instrumentation is utilized to determine the presence or absence of the bonded coupon.

18 Claims, 3 Drawing Figures

METHOD AND APPARATUS OF THERMAL DETECTION USING BONDED COUPON

FIELD AND BACKGROUND OF THE INVENTION

The present invention relates, in general, to thermal detection techniques and, in particular, to a new and useful method and apparatus for determining the exposure of a component to a selected temperature above an ambient, by examining the component for the presence or absence of a coupon which has previously been bonded to the component utilizing a bonding agent which fails at the selected temperature.

Heavy oil and tar sands represent huge untapped resources of liquid hydrocarbons which will be produced in increasing quantities to help supplement declining production of conventional crude oil. These deposits must, however, be heated to reduce the oil viscosity before it will flow to the producing wells in economical quantities. The dominant method of heating is by injection of surface generated steam in either a continuous (steam flood) or intermittent (steam stimulation or "huff and puff") mode.

When steam is injected down long injection pipes or "strings", a significant amount of thermal energy is lost to the rock overburden (500 to 700 feet) which covers the oil deposit. In the initial steam injection projects, the price of oil did not justify the prevention of this heat loss, but now with the price of oil at $30.00 or more a barrel, insulation systems for the well injection pipe become economically justified.

Several methods are known for determining the exposure of a component to an excess selected temperature which is indicative of insulation failure. Such methods include the real time or service monitoring of surface temperature using thermocouples, thermistors, thermometers, optical pyrometers or infrared cameras.

A system of monitoring the input and output fluid temperatures may also be utilized for determining the integrity of the insulation, where the component is designed for conveying a fluid. Additionally, a measurement of power output verses fuel consumption, i.e., efficiency, gives an indication of the state of the insulation since, a degraded insulation would reduce efficiency.

In all of the aforementioned techniques, once the component has cooled to ambient temperature, the evidence of thermal failure is no longer present. The techniques must be exercised during real time and thus are limited to cases where real time monitoring is possible and practical.

Off-line Thermal Testing Techniques are also known which either directly establish the integrity of the insulation or infer this integrity. The component is removed from service for testing.

According to one technique, an induced heat flow using an induction heater is monitored by an infrared camera or other temperature sensing equipment. Alternatively, the component can be placed into a test loop in which thermal efficiency is measured.

Thermal failure can be inferred in an off-line situation by observing the conditions of the component or some part thereof, which has previously been exposed to overheating. Visual inspection may determine severe degradation, for example, warping or melting of the component due to overheating. Discoloration of the normal surface appearance is also a clue to thermal failure. This discoloration may be indicative of a change in tempering or the like. A paint that permanently changes color when exposed to a particular temperature can be applied to such things as storage tanks in chemical factories. The usefulness of such a paint for rugged extreme environments has not been established, however, in particular for oil well environments where steam is injected into a well to extract otherwise "frozen" oil supplies.

It is known to utilize injected steam to extract such oil supplies. Such steam is injected into a well using an insulated steam injection tube which, in known fashion, comprises inner and outer coaxial tubes defining between them an annular space which is provided with insulation means, such as thermal insulation and evacuation of the space to obtain a vacuum. The use of insulation between the coaxial tubes is disclosed, for example, in U.S. Pat. No. 3,574,357 to Alexandru et al and U.S. Pat. No. 3,478,783 to Doyle.

SUMMARY OF THE INVENTION

An object of the present invention is to provide a technique, including a method and apparatus, for determining the exposure of a component to an excess selected temperature above an ambient, which selected temperature corresponds, for example, to the temperature at which insulation associated with the component has failed.

According to the invention, a thin wafer or element, here collectively termed a coupon, is bonded to the surface of the component with a substance which melts or degrades at or above selected temperature. If the operating temperature then exceeds its design limits, the coupon will fall off, thereby providing a ready indication of thermal failure.

The invention is particularly suited to conditions experienced in oil wells where the delicate instrumentation, such as thermocouples and the like, is not feasible. The wafer or element may be made of steel, plastic or other material, depending on the environment with the bonding agent being a brazing or soldering alloy which is designed to melt at a particular temperature, an epoxy or the like.

A number of coupons designed for various temperature ranges may be affixed to a component to give an idea of the severity of the insulation failure. Alternatively, a single coupon or wafer may be utilized.

The coupon or coupons may be adhered either to the outside of the inside of the components. Particularly in the harsh environments, such as those of an oil well, it is best to adhere the coupon to the interior of outer tubular components. The failure of the bonding agent and, thus, loss of adhesion between the coupon and inner surface of the outer tube can be detected using an ultrasonic transducer.

Accordingly, another object of the present invention is to provide a method of detecting the exposure of a component to a selected temperature above an ambient, during an operation, comprising, bonding a coupon to the components using a bonding agent which is capable of withstanding temperatures only up to the selected temperature, above which the bonding agent no longer holds the coupon to the component, initiating the operation and observing the component to determine whether the coupon is bonded thereto.

A further object of the invention is to provide an apparatus which is useful in detecting an exposure of the apparatus to a selected temperature above an ambient during an operation comprises an outer tube, an inner tube coaxial to the outer tube and insulation between the inner and outer tube, with a coupon bonded to at least one of an inner and outer surface of the outer tube, the coupon being bonded with a bonding agent which is capable of withstanding temperatures only up to the selected temperature, above which the bonding agent is no longer capable of holding the coupon to the component.

A still further object of the invention is to provide such an apparatus and method of detecting the exposure of a component to a selected temperature, which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENTS

Figure 1:
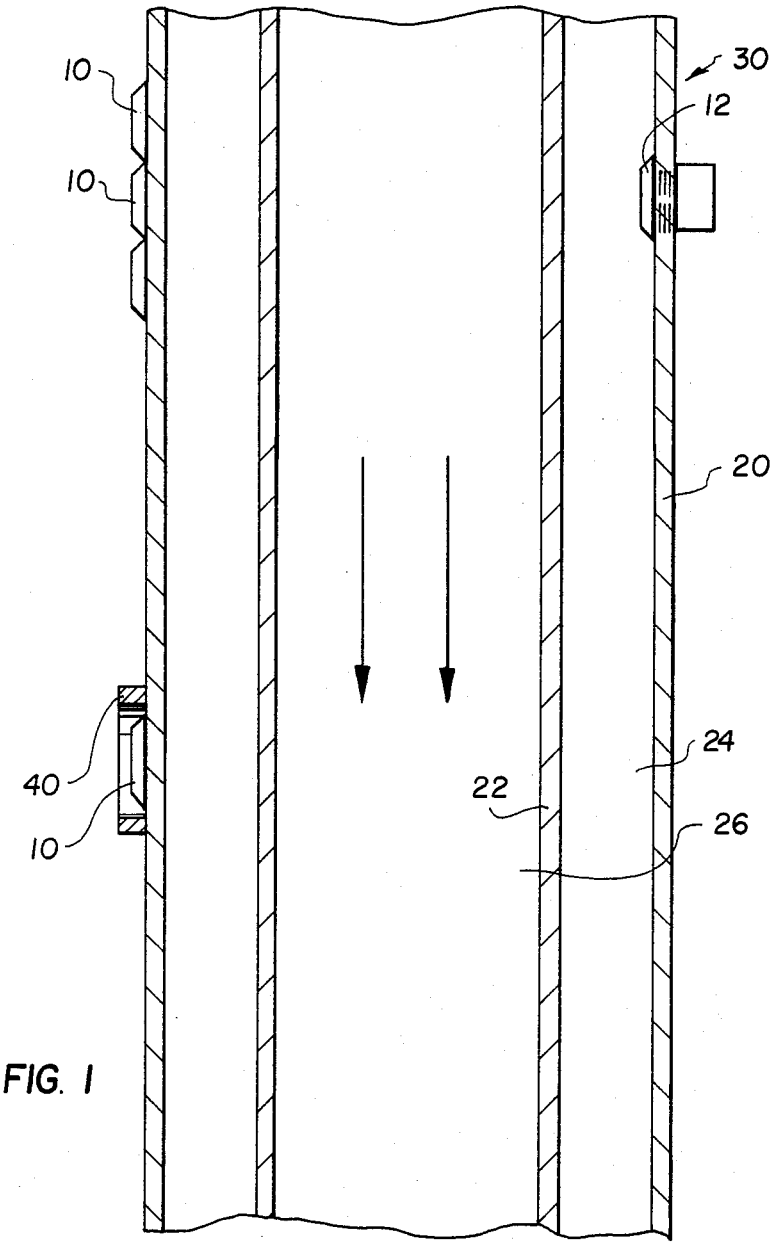
FIG. 1 is a side elevational view of an insulated steam injection tube illustrating the invention.

Referring to the drawings, in particular, the invention embodied therein, as illustrated in FIG. 1, utilizes a wafer, element or coupon 10 which can be bonded to the exterior surface of an outer tube 20 of an insulated steam injection tube generally designed 30. Tube 30 comprises in addition to the outer tube 20, an inner tube 22 which defines with the outer tube an annular space 24 which can either be filled with insulation or exposed to a vacuum or both for insulatin;g the inner component from the outer component. The inner space 26 defined by inner tube 22 receives a flow of steam in known fashion. With failure of the insulation means in space 24, the outer tube or component 20 is exposed to a temperature above ambient temperature and above a design limit. Such insulation failure drastically reduces the efficiency of the operation in that much heat is lost from the steam before it can be utilized to extract oils from the well.

Coupons 10 are bonded to the outer component 20 using a bonding agent which is designed to melt or degrade at and above the selected overtemperature. By mounting the coupon 10 on the exterior of component 20, simple visual inspection of the component upon routine removal of the components from the well will determine the presence or absence of the coupon, thus the exposure of the component to the overtemperature. In view of the rigorous environment of an oil well, the coupons 10 are provided with bevelled edges to prevent their being mechanically dislodged from their bonded position.

Figure 2:
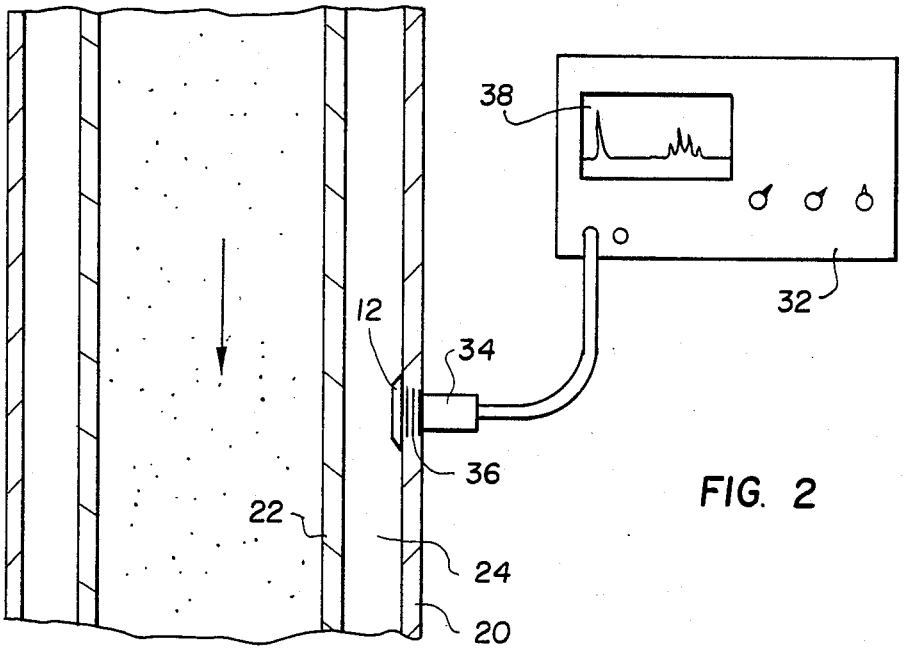
FIG. 2 is a view similar to FIG. 1 of another embodiment of the invention.

An alternate form of the invention provides for the bonding of one or more coupons 12 to the interior surface of component 20. Since simple visual inspection now becomes impossible for determining the presence or absence of the coupon, an ultrasonic transducer 34 shown in FIG. 2 can be utilized. Such ultrasonic transducers are known and are useful in determining the thickness of metal parts. Such ultrasonic transducers are discussed in the publication STEAM, ITS GENERATION AND USE, 39th edition, 1978, The Babcock & Wilcox Company, pages 31-7 and 31-8. In addition to ultrasonic transducers, other non-destructive examination techniques such as the use of eddy current sensors and x-ray means may be useful for detecting the presence of the coupon and/or the bonding agent on the interior surface of component 20. Such techniques are meant to come within the scope of the claims of this invention.

Ultrasonic transducers essentially measure the wall thickness of a component. With coupon 12 mounted in a known location along the tube 20, the ultrasonic instrument 32 can be utilized to determine whether the coupon is at the position or not. Even if the coupon is held at the position by the surrounding insulation, the fact that the coupon is no longer bonded to the interior surface of tube 20, is detected by the ultrasonic instrument in that the interface which is established between the coupon and the inner surface is broken.

Figure 3:
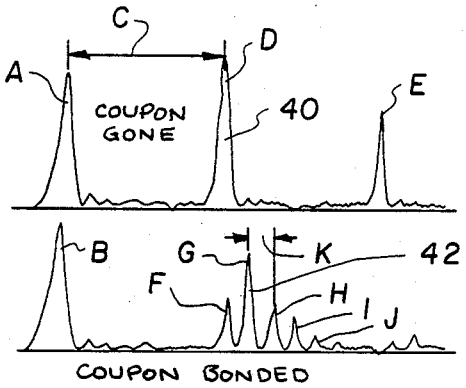
FIG. 3 is a representation of two displays from an ultrasonic instrument which are indicative of the presence and absence of a coupon.

The ultrasonic instrument 32, using an ultrasonic transducer 34, generates and transmits ultrasonic waves shown at 36 through the component 20 and, with coupon 12 adhered, through the coupon as well. A CRT display 38 is utilized to determine the presence or absence of the coupon. Alternatively, a digital thickness type ultrasonic instrument can be utilized which provides a reading of the wall thickness directly in inches or millimeters. As shown in FIG. 3, curve 40 shows the CRT display when the coupon is gone and curve 42 shows the CRT display when the coupon is in place and bonded to the component. These curves are illustrative and do not necessarily depict the exact response obtained for any particular coupon and transducer combination. A discussion of the ultrasonic testing of bonded elements can be found in *Ultrasonics,* 2nd edition, Carlin, McGraw Hill 1960, at page 270. It is there noted that the bond between metal and other material can be shown by ultrasonic testing and that when the bond between the back of a metal part and a material bonded thereto is defective, the signal of the tester will be affected.

In manufacturing the inventive apparatus, the string lengths of tubing are provided at one or more known locations with coupons 10 or 12. After the strings are utilized in the well to supply steam thereto, they are withdrawn and replaced on their racks in known fashion. The strings can then be examined either visually for exteriorly connected coupons or using ultrasonic instruments for interiorly bonded coupons to determine the integrity of insulation of each string. Strings with degraded insulation can thus be eliminated from future operations.

Advantages of the invention include the fact that thermal integrity can be established easily and quickly, no reheating of the component is necessary, inexpensive and portable test equipment can be utilized in a fast manner by unskilled operators and the testing operation is of the simple "go-no-go" type.

As compared with paint which changes color upon the exposure to a selected temperature, the invention is advantageous in that no false reading can be provided by contamination with dirt or other chemical reactions as is the case for the paint. Also, no subjective decision is required in determining whether a color change has, in fact, taken place.

TABLE I

| BONDING AGENT | MELTING OR DEGRADING TEMP (°C.) |
|---|---|
| 50% Sn/50% In-Solder | 117–126 |
| 63% Sn/36.65% Pb/0.35% Sb | 183 |
| 63% Sn/37% Pb-Solder | 183 |
| 96% Sn/4% Ag-Solder | 221 |
| 95% Sn/5% Sb-Solder | 232–238 |
| 93% Pb/5.2% Sn/1.8% Ag | 299 |
| 45% Ag/24% Cd/16% Zn/15% Cu | 607–618 |

The bonding agent itself may be used as the coupon. The transducer measures the thickness of the bonding agent as well as the coupon thickness especially if the bonding agent is metallic. The bonding agent may be placed in the annulus with the tubes in a horizontal position for baking-out the tubes (heating the tubes to remove gases from the surfaces thereof). The tubes are then allowed to cool and the bonding agent solidify on the interior surface of the outer tube while the tubes are still horizontal. The bonding agent may be provided as a solidified puddle or a small reservoir may be provided in the outer tube wall to contain it.

It is possible that a high temperature could cause the bonding agent to melt and fall toward the bottom of the tubing but wherein the coupon may remain in position because of being held there by the insulation. However, in such a case, the tubing wall thickness only would be measured since sonic waves (typically 3 to 5 megahertz waves) will not cross the interface with the coupon if the coupon is not bonded to the wall. The bond must be a solid bond that excludes air. If the coupon were only partially bonded, a skilled operator would recognize it and move the instrument around for additional measurements.

An advantage of the coupon, however, over just a bonding agent is the added thickness of the coupon for easier measurement. The coupon may be in the form of a circumferential ring which allows for easy determination of the location for taking the measurement by measuring a specified distance from one end of the component.

Rings 40 may be welded around the coupons (when the coupons are bonded to the exterior surface of the outer tube) to protect them. Also, they may have beveled edges for additional protection. Alternately, the coupons may be located in recesses or notches in the surface of the outer tubular 20.

Referring to FIG. 3, the distance along the x-axis represents time which is related to thickness of material in which a signal is reverberating. Distance along the y-axis represents signal strength each time the wave is measured by the instrument as it reverberates within the material. Points A and B represent the strength of the initial excitation pulse of the transducer. The distance C represents the wall thickness. Point D indicates a reflection of substantially all of the energy of the signal to the wall surface, and point E indicates another reverberation of the signal through the wall thickness with there being, of course, some energy loss. Point F represents a substantially lesser reflection of energy of the signal through the wall since a substantial amount of the energy continues to travel through the coupon. Points G, H, I, and J represent reverberations of the signal in the coupon with successive loss of energy on each reverberation. Distance K therefore represents coupon thickness.

The annular space between the inner and outer tubes or tubulars may advantageously be insulated with fibrous or layered insulation, and/or evacuated to establish a thermal barrier. The space, when evacuated, may also be provided with a getter material which absorbs gas that may migrate into the space, to maintain the vacuum. Such gases include hydrogen from corrosion of the outer tube and $N_2$, CO or $O_2$ which is outgassed from the inner tube. The getter material (e.g. titanium) is placed adjacent the inner tube so as to be exposed to the elevated steam temperature of 400° to 700° F., and activated to more effectively absorb the stray gases.

While specific embodiments of the invention have been shown and described in detail to illustrate the application of the principles of the invention, it will be understood that the invention may be embodied otherwise without departing from such principles.

What is claimed is:

1. A method of detecting the exposure of an inner surface of a component wall to a selected temperature above an ambient, during an operation, comprising:

bonding a coupon to the component wall inner surface using a bonding agent which changes state from a solid to a liquid at a temperature which is equal to at least the selected temperature, whereby the bonding agent no longer bonds the coupon to the component when the component is exposed to the selected temperature;

initiating the operation; and sonically measuring, from a position on the opposite side of the component wall from said inner surface, thickness through the component wall and any coupon bonded thereto at the location where the coupon was bonded to the component wall to determine whether the coupon is bonded to the component wall.

2. A method according to claim 1, wherein the bonding agent melts at selected temperature.

3. A method according to claim 1, wherein said bonding agent degrades at selected temperature.

4. A method according to claim 1, wherein the component wall is insulated at the inner surface thereof by insulation means, said selected temperature being indicative of a failure of the insulation means.

5. A method according to claim 1, wherein said bonding agent is solder chosen from the group consisting of a tin alloy, a lead alloy, a silver alloy and a copper alloy.

6. A method according to claim 1 wherein the step of measuring thickness comprises disposing an ultrasonic transducer on the opposite side of the component wall from the location on the inner surface of the component wall where the coupon was bonded, and transmitting ultrasonic waves through the component wall to the inner surface at said location and through any coupon bonded to the inner surface at said location.

7. An apparatus for detecting the exposure of an inner surface of a component wall to a selected temperature above an ambient during an operation comprising a coupon bonded to said inner surface of the component wall with a bonding agent which changes state from a solid to a liquid at a temperature which is equal to at least the selected temperature whereby the bonding agent is not capable of bonding the coupon to the component wall when the component wall is exposed to the selected temperature, and means, positioned on the opposite side of the component wall from said inner surface, for sonically measuring thickness through the component wall and any coupon bonded thereto at the location where the coupon was bonded to the component wall.

8. Apparatus according to claim 7 wherein said thickness measuring means comprises an ultrasonic transducer.

9. An insulated steam injection tube comprising:

an outer tube;

an inner tube mounted within said outer tube and defining an annular space between the inner and outer tube walls;

insulation means in said annular space for insulating said outer tube from said inner tube;

a wafer bonded to an inner surface of said outer tube wall with a bonding agent which changes state from a solid to a liquid at a temperature which is at least equal to the selected temperature whereby the bonding agent no longer bonds said wafer to said outer tube when the outer tube is exposed to the selected temperature whereby detection that the wafer is no longer bonded to said outer tube is indicative of an exposure of said outer tube to the selected temperature; and means, positioned on the opposite side of the outer tube wall from said inner surface, for sonically measuring thickness through the outer tube wall and any wafer bonded thereto at the location where the wafer was bonded to the outer tube wall to detect whether the wafer is still bonded to said outer tube.

10. A tube according to claim 9 wherein said thickness measuring means comprises an ultrasonic transducer.

11. A method of detecting the exposure of an inner surface of a component wall to a selected temperature above an ambient, during an operation, comprising:

applying a bonding agent to the component wall inner surface which bonding agent changes state from a solid to a liquid at a temperature which is equal to at least the selected temperature, whereby the bonding agent no longer adheres to the component wall when the component wall is exposed to the selected temperature;

initiating the operation; and sonically measuring, from a position on the opposite side of the component wall from said inner surface, thickness through the component wall and any bonding agent bonded thereto at the location where the bonding agent was bonded to the component wall to determine whether the bonding agent is bonded to the component wall.

12. A method according to claim 11, including bonding a coupon to the component wall using the bonding agent and observing the component wall to determine whether the coupon is bonded to the component wall after the initiation of the operation.

13. A method according to claim 11, including applying at least two bonding agents having different melting temperatures to the component wall.

14. A method according to claim 12, including bonding at least two coupons to the component wall using two different bonding agents having different melting points.

15. A method according to claim 11, wherein the component comprises an outer tubular of an insulated steam injection tube formed of the outer tubular and an inner tubular spaced inwardly of the outer tubular and forming an annular space therewith, said bonding agent being applied to an inner surface of said outer tubular.

16. A method according to claim 15, including bonding a coupon using said bonding agent to the inner surface of the outer tubular.

17. A method according to claim 16, wherein said coupon has bevelled edges.

18. A method according to claim 11 wherein the step of measuring thickness comprises disposing an ultrasonic transducer on the opposite side of the component wall from the location on the inner surface of the component wall where the bonding agent was bonded, and transmitting ultrasonic waves through the component wall to the inner surface at said location and through any bonding agent bonded to the inner surface at said location.

* * * * *